US012098604B2

(12) United States Patent
Taha et al.

(10) Patent No.: US 12,098,604 B2
(45) Date of Patent: Sep. 24, 2024

(54) DOWNHOLE TUBING DISCONNECT TOOL

(71) Applicant: Saudi Arabian Oil Company, Dhahran (SA)

(72) Inventors: Syed Muhammad Bin Syed Taha, Dhahran (SA); Amr Mohamed Zahran, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 46 days.

(21) Appl. No.: 17/962,788

(22) Filed: Oct. 10, 2022

(65) Prior Publication Data

US 2024/0117692 A1 Apr. 11, 2024

(51) Int. Cl.
*E21B 23/00* (2006.01)
*E21B 17/046* (2006.01)
*E21B 17/06* (2006.01)

(52) U.S. Cl.
CPC ..... *E21B 23/00* (2013.01); *E21B 17/0465* (2020.05); *E21B 17/06* (2013.01)

(58) Field of Classification Search
CPC ..... E21B 17/06; E21B 17/04; E21B 17/02; E21B 17/043; E21B 17/021; E21B 17/046; E21B 17/0465; E21B 17/041; E21B 17/042; E21B 23/00; E21B 23/02
See application file for complete search history.

(56) References Cited

U.S. PATENT DOCUMENTS 3,753,471 A * 8/1973 Kammerer, Jr ..... F16D 1/10 175/320
4,290,484 A * 9/1981 Beall ..... E21B 17/07 285/302
4,441,560 A 4/1984 Baugh et al.
7,059,881 B2 6/2006 Song et al.
8,534,714 B2 9/2013 Buchanan et al.
11,072,987 B2 7/2021 Cridland et al.
2007/0034372 A1* 2/2007 Moyes ..... E21B 31/20 166/250.1
2014/0083708 A1 3/2014 Beck et al.
2014/0352975 A1* 12/2014 Rogers ..... E21B 43/10 166/242.6
2015/0252635 A1* 9/2015 Hartley ..... E21B 23/00 166/77.51

FOREIGN PATENT DOCUMENTS

GB 2360055 9/2001

OTHER PUBLICATIONS

International Search Report and Written Opinion in International Appln. No. PCT/US2023/034815, mailed on Jan. 8, 2024, 14 pages.

* cited by examiner

*Primary Examiner* — George S Gray
(74) *Attorney, Agent, or Firm* — Fish & Richardson P.C.

(57) ABSTRACT

A downhole tubing disconnect assembly includes a first tubing portion disposed in a wellbore, a second tubing portion downhole of the first tubing portion, and an actuation sleeve positioned between the first tubing portion and the second tubing portion. The actuation sleeve has a cylindrical body that selectively connects the first tubing portion and the second tubing portion. The actuation sleeve includes an uphole portion of the cylindrical body to selectively engage the first tubing portion, a downhole portion of the cylindrical body to selectively engage the second tubing portion, and a shifting profile in the cylindrical body. The shifting profile selectively engages a shifting tool disposed within the wellbore.

21 Claims, 5 Drawing Sheets

DOWNHOLE TUBING DISCONNECT TOOL

TECHNICAL FIELD

This disclosure generally relates to tubing disconnect tools, such as downhole tubing disconnect and reconnect tools.

BACKGROUND

Downhole tubing in wellbores, such as drill strings, production tubing, or other well tubing, often experiences damage to tubing components during downhole use. Damage to downhole, or sub-surface, tubing such as production piping often occurs close to the surface. When the damage to the tubing reaches critical levels, such as when a wall thickness loss exceeds acceptable levels, the tubing must be replaced, triggering a workover operation where the entire tubing string is retrieved and replaced. Sometimes, an entire upper completion tubing is discarded to address damage sustained to only a small section of the tubing near the surface.

SUMMARY

This disclosure describes downhole tubing disconnect assemblies, including tubing disconnect tools for downhole tubing strings.

In some aspects, a downhole tubing disconnect assembly includes a first tubing portion configured to be disposed in a wellbore, the first tubing portion including a first inner surface defining a first central bore, and a first outer surface, and a second tubing portion configured to be disposed in the wellbore downhole of the first tubing portion, the second tubing portion including a second inner surface defining a second central bore in fluid communication with the first central bore, and a second outer surface. The disconnect assembly also includes an actuation sleeve having a substantially cylindrical body positioned between the first tubing portion and the second tubing portion and selectively connecting the first tubing portion and the second tubing portion. The actuation sleeve includes an uphole portion of the cylindrical body to selectively engage the first tubing portion, a downhole portion of the cylindrical body to selectively engage the second tubing portion, and a shifting profile in the cylindrical body. The shifting profile selectively engages a shifting tool disposed within the wellbore.

This, and other aspects, can include one or more of the following features. The uphole portion of the actuation sleeve can include a first locking mechanism to position the uphole portion on the first tubing portion, and the downhole portion of the actuation sleeve can include a second locking mechanism configured to position the downhole portion on the second tubing portion. The first tubing portion can include a first slot along the first inner surface of the first tubing portion and a second slot along the first inner surface spaced axially apart from the first slot, and the first locking mechanism can engage the first slot in a first position of the actuation sleeve and engage the second slot in a second position of the actuation sleeve. The first locking mechanism can include at least one spring-loaded dog configured to reside in the first slot in the first position and reside in the second slot in the second position. The second tubing portion can include a third slot along the second inner surface of the second tubing portion, and the second locking mechanism can engage the third slot in a first position of the actuation sleeve. The second locking mechanism can include at least one spring-loaded dog configured to reside in the third slot in the first position of the actuation sleeve. The downhole tubing disconnect assembly can further include a perforated shell sub between the first tubing portion and the second tubing portion, where the perforated shell sub at least partially surrounds the actuation sleeve and extends from the first outer surface of the first tubing portion to the second outer surface of the second tubing portion. The perforated shell sub can include a plurality of perforations through the perforated shell sub. The actuation sleeve can include a first seal between an outer surface of the uphole portion and the first inner surface of the first tubing portion, and a second seal between an outer surface of the downhole portion and the second inner surface of the second tubing portion. The actuation sleeve can include a full-bore pass through along an entire longitudinal length of the actuation sleeve. The shifting profile in the cylindrical body can include an indent in an inner surface of the cylindrical body, the indent configured to selectively engage the shifting tool. The first tubing portion and the second tubing portion can include production tubing.

Certain aspects of the disclosure encompass a method for disconnecting a tubing in a wellbore. The method includes disposing a downhole tubing disconnect assembly within a wellbore. The downhole tubing disconnect assembly includes a first tubing portion comprising a first inner surface defining a first central bore, and a first outer surface, a second tubing portion downhole of the first tubing portion and comprising a second inner surface defining a second central bore in fluid communication with the first central bore, and a second outer surface, and an actuation sleeve including a substantially cylindrical body having a central bore. The substantially cylindrical body is positioned between the first tubing portion and the second tubing portion, and the actuation sleeve connects the first tubing portion and the second tubing portion. The method also includes engaging, with a shifting tool supported on a tubing string disposed in the central bore of the actuation sleeve, a shifting profile in the substantially cylindrical body. In response to engaging the shifting profile with the shifting tool, the actuation sleeve translates from a first position to a second position, and the actuation sleeve disconnects from the second tubing portion.

These, and other aspects, can include one or more of the following features. Engaging the shifting profile with the shifting tool can include positioning the shifting tool within the shifting profile of the substantially cylindrical body, and jarring the shifting tool in an uphole direction. Translating the actuation sleeve from the first position to the second position can include disengaging a first locking mechanism of the actuation sleeve from a first slot of the first tubing portion, translating the actuation sleeve relative to the first tubing portion, and engaging the first locking mechanism with a second slot of the first tubing portion. Disconnecting the actuation sleeve from the second tubing portion can include disengaging a second locking mechanism of the actuation sleeve from a third slot of the second tubing portion. The method can further include at least partially surrounding the actuation sleeve with a perforated shell sub, the perforated shell sub extending from the first outer surface of the first tubing portion and the second outer surface of the second tubing portion. The perforated shell sub can include perforations through the perforated shell sub, and surrounding the actuation sleeve with the perforated shell sub can include equalizing pressure across the perforated shell sub with the perforations. The method can further include removing the first tubing portion and actuation sleeve from the wellbore, running a third tubing portion and second actuation sleeve into the wellbore, and connecting the third tubing portion and second actuation sleeve to the second tubing portion.

In certain aspects, a tubing disconnect tool includes a first tubing portion including a first inner surface defining a first central bore, a second tubing portion separate from the first tubing portion, the second tubing portion including a second inner surface defining a second central bore, and an actuation sleeve positioned between the first tubing portion and the second tubing portion and selectively connecting the first tubing portion and the second tubing portion. The actuation sleeve includes a full-bore pass through fluidly connecting the first central bore and the second central bore, and includes an uphole portion to selectively engage the first tubing portion, a downhole portion to selectively engage the second tubing portion, and a shifting profile configured to selectively engage a shifting tool.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
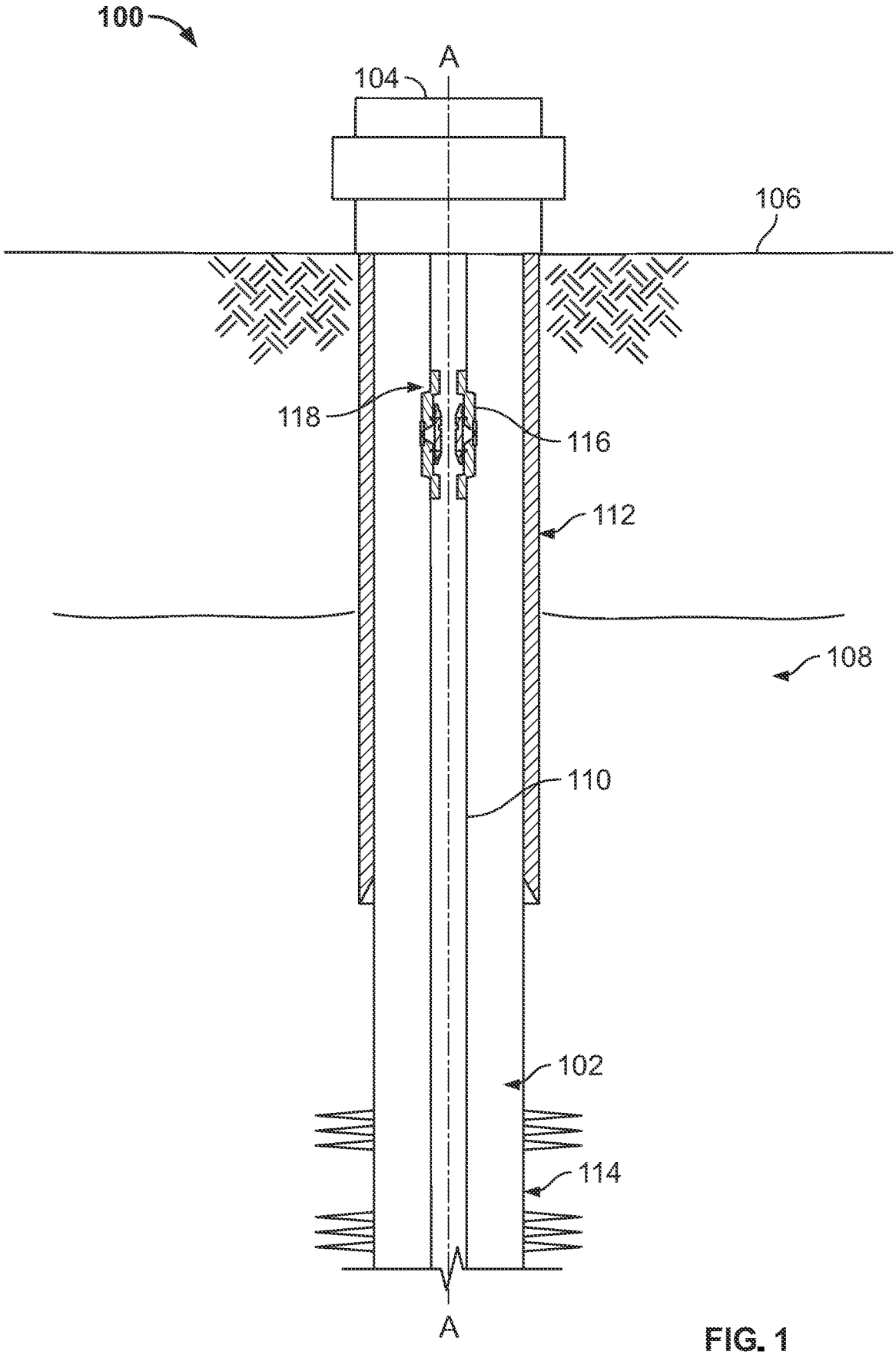
FIG. 1 is a schematic, partial cross-sectional side view of an example well system including an example tubing disconnect assembly.

This disclosure describes a downhole tubing disconnect assembly for disconnecting a first tubing section from a second tubing section disposed downhole in a wellbore. The downhole tubing disconnect assembly can also be used to remove the first tubing section, and subsequently reconnect a third tubing section to the second tubing section. The downhole tubing disconnect assembly resides along a tubing string between an uphole tubing portion and a downhole tubing portion, couples to the uphole tubing portion and a downhole tubing portion, and in some instances, fluidly connects the uphole tubing portion with the downhole tubing portion via a central bore through the downhole tubing disconnect assembly. The tubing disconnect assembly can be positioned at any point along the tubing string, such as close to a surface of a well or further downhole from the well surface. The tubing disconnect assembly includes a first tubing portion that couples to the adjacent uphole portion of the tubing string, a second tubing portion that couples to the adjacent downhole portion of the tubing string, where the first tubing portion is uphole of the second tubing portion. The tubing disconnect assembly also includes a movable actuation sleeve between the first tubing portion and the second tubing portion, where the actuation sleeve selectively connects the first tubing portion to the second tubing portion. In some implementations, the first tubing portion, actuation sleeve, and second tubing portion define a full-bore pass through that fluidly connects an internal fluid flow along the tubing string and through the tubing disconnect assembly. The actuation sleeve can slide, or translate, along an inner surface of the first tubing portion from a first position to a second position. In the first position, the actuation sleeve couples to the first tubing portion and second tubing portion (for example, with locking mechanisms such as spring-loaded dogs that engage corresponding slots in the first and second tubing portions), whereas in the second position, the actuation sleeve couples to the first tubing portion and is disconnected from the second tubing portion. The actuation sleeve can be actuated by a shifting tool that is run into the central bore of the tubing disconnect assembly, for example, on a slickline, coiled tubing, or other well string, to engage a shifting profile of the actuation sleeve and cause the actuation sleeve to move from the first position to the second position. Once the actuation sleeve is disconnected from the second tubing portion, the first tubing portion and the adjacent uphole portion of the tubing string can be retrieved from the wellbore. In some instances, a replacement tubing portion with the same or similar first tubing portion can be run into the wellbore to reconnect with the second tubing portion and the adjacent downhole portion of the tubing string.

The downhole tubing disconnect assembly of the present disclosure allows for the retrieval of a section of tubing from a wellbore, such as a small portion of downhole tubing positioned close to a well surface. The section of tubing can be removed from the wellbore, and a replacement section of tubing can be run into and reconnected to the existing tubing disposed in the wellbore. The disconnect and reconnect operation provides continuity in fluid flow path through the tubing and pressure retention capability in the tubing. The downhole tubing disconnect assembly allows for the retrieval and replacement of a small portion of the tubing string without requiring the retrieval of the entire tubing string from the wellbore, which improves operation efficiency by reducing the operational complexity involved in full well workovers to change out an entire tubing string, such as a production tubing string. This operational efficiency reduces operational costs at a well site by avoiding the costs involved in replacing an entire tubing string or a majority of a tubing string, as well as avoiding or reducing the costs involved in workover rig operations.

FIG. 1 is a schematic, partial cross-sectional side view of an example well system 100 that includes a substantially cylindrical wellbore 102 extending from a well head 104 at a surface 106 downward into the Earth into one or more subterranean zones of interest 108 (one shown). The example well system 100 includes a vertical well, with the wellbore 102 extending substantially vertically from the surface 106 to the subterranean zone 108. The concepts herein, however, are applicable to many other different configurations of wells, including horizontal, slanted, or otherwise deviated wells. A well string 110 is shown as having been lowered from the surface 106 into the wellbore 102. The well string 110 is disposed within the wellbore 102, and is substantially cylindrical about central axis A-A. In certain instances, after some or all of the wellbore 102 is drilled, a portion of the wellbore 102 is lined with lengths of tubing, called casing 112. The wellbore 102 can be drilled in stages, and the casing 112 may be installed between stages. The casing 112 can include a series of jointed lengths of tubing coupled together end-to-end or a continuous (for example, not jointed) coiled tubing. The casing 112 forms the cased section of the wellbore 102. In some examples, the well system 100 excludes casings, such as casing 112, and the wellbore 102 is at least partially or entirely open bore. The section(s) of the wellbore 102 exposed to the adjacent formation (for example, without casing or other permanent completion) form the open hole section 114 of the wellbore 102.

In the example well system 100 of FIG. 1, the well string 110 includes a tubing disconnect tool 118 that can form part of a downhole tubing disconnect assembly 116 for disconnecting the well string 100 at the disconnect tool 118 and, in some instances, reconnect a replacement portion of tubing to the well string 100 at the location of the tubing disconnect tool 118. While the example well system 100 includes a single tubing disconnect tool 118 along the well string 110, the example well system 100 can include additional tubing disconnect tools along the same well string 110 at various downhole positions along the well string 110. The disconnect tool 118 and corresponding tubing disconnect assembly 116 operates to disconnect the well string 110 at the location of the respective disconnect tool 118 in order to remove the portion of the well string 110 uphole of the disconnect tool 118 from the wellbore 102 while the portion of the well string 110 that is downhole of the disconnect tool 118 remains in the wellbore 102. In certain implementations, the tubing disconnect assembly 116 can run in the same uphole tubing section or replacement tubing section into the wellbore 102 to re-connect with the portion of the well string 110 that still resides in the wellbore 102.

The tubing disconnect assembly 116 and corresponding tubing disconnect tool 118 of the example well system 100 of FIG. 1 is shown as positioned close to the well surface 106, such as at or within about 1,100 feet (about 335 meters) of the surface 106. Locating the tubing disconnect tool 118 close to the surface 106, such as shown in FIG. 1, allows for the retrieval and replacement of a portion of the well string 110 between the disconnect tool 118 and the well head 104, for example, without removing the entirety of the well string 110 from the wellbore 102. However, the location of the tubing disconnect assembly 116 and corresponding disconnect tool 118 on the well string 110 can vary. For example, the disconnect tool 118 can be at any intermediate location on the well string 110 between an uphole end and a downhole end of the well string 110.

In the example well system 100 of FIG. 1, the well string 110 is made up of production tubing, and can take the form of a production well string. The well string 110 can take a variety of other forms, for example, based on any other types of tools carried on the well string 110. In some implementations, the well string 110 is a drill string, production string, a testing string, a wireline, a completion string, or another type of tubing string. Though the example well system 100 of FIG. 1 shows one disconnect tool 118 along the well string 110, the number of well tools on the well string 110 can vary. For example, the well system 100 can include additional well tools uphole of or downhole of the disconnect tool 118 along the well string 110. The tubing disconnect assembly 116 and disconnect tool 118 are rugged enough to withstand the harsh wellbore environment and to be included on an actively producing production string (or other type of well string).

Figure 2:
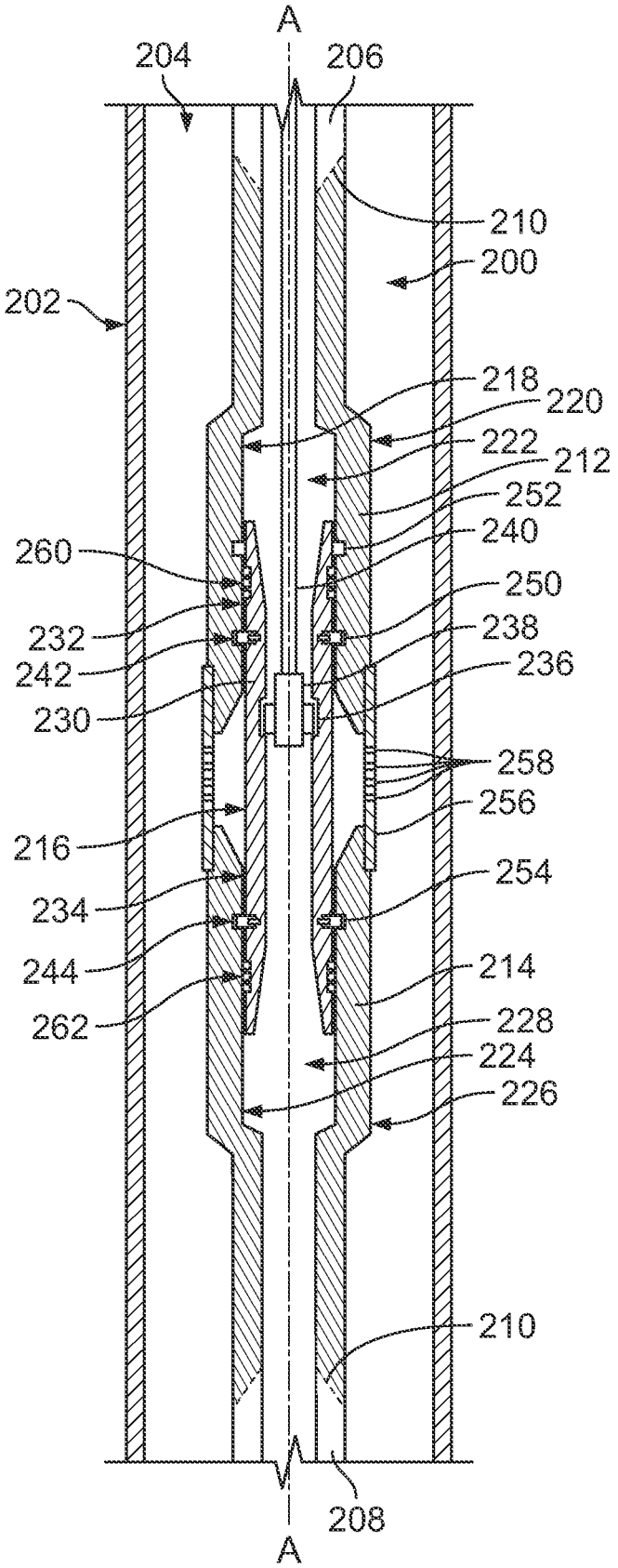
FIG. 2 is a schematic, partial cross-sectional side view of an example tubing disconnect tool that can be used in the example tubing disconnect assembly of FIG. 1.

FIG. 2 is a schematic, partial cross-sectional front view of an example downhole tubing disconnect assembly 200 disposed in a casing 202 of a wellbore 204. The example downhole tubing disconnect assembly 200 is in line with and coupled to a well tubing, specifically, an adjacent uphole tubing 206 and an adjacent downhole tubing 208. The tubing disconnect assembly 200 couples to the adjacent uphole tubing 206 and adjacent downhole tubing 208 with tubing connections 210, which can include a pin and box connection or other tubing coupling type, or the tubing sections can be integrally formed. The example downhole tubing disconnect assembly 200 can be used in the example well system 100 of FIG. 1, such as the downhole tubing disconnect assembly 116 and disconnect tool 118 within the cased wellbore 102 of FIG. 1.

The example downhole tubing disconnect assembly 200 includes a first tubing portion 212, a second tubing portion 214, and an actuation sleeve 216 disposed in the wellbore 102. The first tubing portion includes a first inner surface 218 defining a first central bore 222 of the first tubing portion 212, and a first outer surface 220. The second tubing portion 214 includes a second inner surface 224 defining a second central bore 228 in fluid communication with the first central bore 222, and a second outer surface 226. The actuation sleeve 216 includes a cylindrical body 230 positioned between the first tubing portion 212 and the second tubing portion 214. The cylindrical body 230 has a substantially or exactly cylindrical shape, though the cylindrical body 230 can include additional features, divots, indentations, or other features that are not cylindrical. The cylindrical body 230 between the first tubing portion 212 and second tubing portion 214, such as from the first central bore 222 to the second central bore 228, and the actuation sleeve 216 connects the first tubing portion 212 and the second tubing portion 214. The actuation sleeve 216 of the example downhole tubing disconnect assembly 200 includes an uphole portion 232 of the cylindrical body 230 selectively engage the first tubing portion 212, and a downhole portion 234 of the cylindrical body 230 to selectively engage the second tubing portion 214.

The cylindrical body 230 of the actuation sleeve 216 also includes a shifting profile 236, which can selectively engage a shifting tool 238 disposed within the wellbore 102, such as within the central bore of the tubing string disposed in the wellbore 102. The shifting profile 236 is shown as an indent in an inner surface of the cylindrical body 230, where the indent is configured to engage a corresponding profile of the shifting tool 238. However, the shifting profile 236 can vary in shape, location, dimension, or a combination of these. The shifting profile 236 engages with the shifting tool 238 so that movement of the shifting tool 238 can be transferred to the actuation sleeve 216. For example, with the shifting tool 238 engaged with the shifting profile 236, as depicted in the example downhole tubing disconnect assembly 200 of FIG. 2, an uphole jerk motion by the shifting tool 238 can be transferred to the actuation sleeve 216 to translate the actuation sleeve 216 in an uphole direction. This movement is described in greater detail later.

In some implementations, the shifting tool 238 can be carried on a dedicated tubing 240, such as on a wireline, slickline, coiled tubing, or other dedicated tubing string. The actuation sleeve 216 can include a full-bore pass through along an entire longitudinal length of the actuation sleeve 216 (for example, along A-A). The full-bore pass through allows for fluid communication between the first tubing portion 212 and adjacent tubing with the second tubing portion 214 and its respective adjacent tubing. The full-bore pass through also allows for the shifting tool 238 to run downhole into the downhole tubing disconnect assembly 200 through the central bore of the tubing to engage the actuation sleeve 216, or in some examples, to continue running downhole of the actuation sleeve 216 to a different well tool downhole of the downhole tubing disconnect assembly 200.

The uphole portion 232 of the actuation sleeve 216 includes a first locking mechanism 242 to position the uphole portion 232 on the first tubing portion 212, and the downhole portion 234 of the actuation sleeve 216 includes a second locking mechanism 244 to position the downhole portion 234 on the second tubing portion 214. The first tubing portion 212 includes a first slot 250 along the first inner surface 218 of the first tubing portion 212 and a second slot 252 along the first inner surface 218. The first slot 250 and the second slot 252 are spaced axially apart from each other. The first locking mechanism 242 can engage the first slot 250 in a first position of the actuation sleeve 216 (as depicted in the example downhole tubing disconnect assembly 200 of FIG. 2), and engage the second slot 252 in a second position of the actuation sleeve 216 (described later). The second tubing portion 214 includes a third slot 254 along the second inner surface 224 of the second tubing portion 214. The second locking mechanism 244 can engage the third slot 254 in the first position of the actuation sleeve 216 to selectively couple the actuation sleeve 216 to the second tubing portion 214.

In some implementations, the first tubing portion 212 and second tubing portion 214 are longitudinally spaced apart from each other along the central axis A-A, and the actuation sleeve 216 acts to couple the first tubing portion 212 to the second tubing portion 214. The first locking mechanism 242 and the second locking mechanism 244 secure the first tubing portion 212 to the actuation sleeve 216 and the second tubing portion 214 to the actuation sleeve 216 and transmits forces, weight, and support between the first tubing portion 212 and second tubing portion 214.

The first locking mechanism 242, the second locking mechanism 244, or both, can include one or more spring-loaded dogs, such as spring-loaded pins, directed radially outward from the outer surface of the cylindrical body 230. For example, in the first locking mechanism 242, the one or more spring-loaded dogs can reside in the first slot 250 in the first position to secure the actuation sleeve 216 to the first tubing portion 212, or can reside in the second slot 252 in the second position to secure the actuation sleeve 216 to the first tubing portion 212. In the second locking mechanism 244, the one or more spring-loaded dogs can reside in the third slot 254. The first locking mechanism 242 and second locking mechanism 244, when engaged with respective slots of the first tubing portion 212 or second tubing portion 214, can transfer forces in the longitudinal direction (parallel to axis A-A) between the actuation sleeve 216 and the first tubing portion 212, second tubing portion 214, or both.

In some implementations, the example downhole tubing disconnect assembly 200 includes a perforated shell sub 256 between the first tubing portion 212 and the second tubing portion 214. The perforated shell sub 256 partially surrounds the actuation sleeve 216 and extends from the first outer surface 220 of the first tubing portion 212 to the second outer surface 226 of the second tubing portion 214. The perforated shell sub 256 extends between the first tubing portion 212 and the second tubing portion 214 to cover the space separating the first tubing portion 212 and second tubing portion 214. The perforated shell sub 256 includes multiple perforations 258 through the perforated shell sub 256, for example, to equalize pressure between an annulus of the wellbore 102 exterior of the downhole tubing disconnect assembly 200 and an interior of the downhole tubing disconnect assembly 200 during a shifting operation of the actuation sleeve 216 between the first position and the second position. The perforations 258 of the perforated shell sub 256 can help reduce or prevent hydraulic lock at the actuation sleeve 216.

In some implementations, the actuation sleeve 216 includes seals between the outer surface of the actuation sleeve 216 and respective inner surfaces of the first tubing portion 212, second tubing portion 214, or both. For example, the actuation sleeve 216 can include a first seal 260 between an outer surface of the uphole portion 232 and the first inner surface 218 of the first tubing portion 212, and a second seal 262 between an outer surface of the downhole portion 234 and the second inner surface 224 of the second tubing portion 214. In some examples, the first seal 260, second seal 262, or both, include a non-elastomeric seal stack. The first seal 260 and second seal 262 can take a variety of other forms, as well.

Figure 3A:
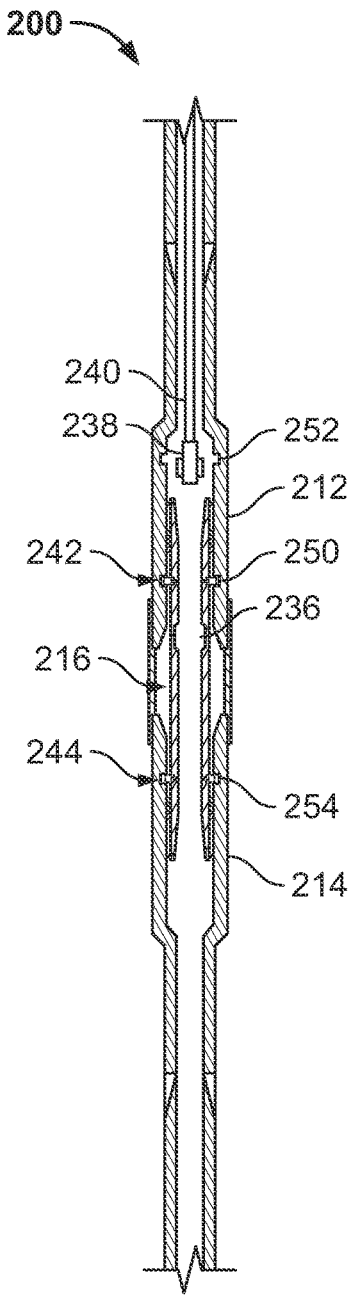
FIGS. 3A-3E are partial cross-sectional schematic views of an example tubing disconnect assembly during a disconnect and reconnect operation.
Figure 3B:
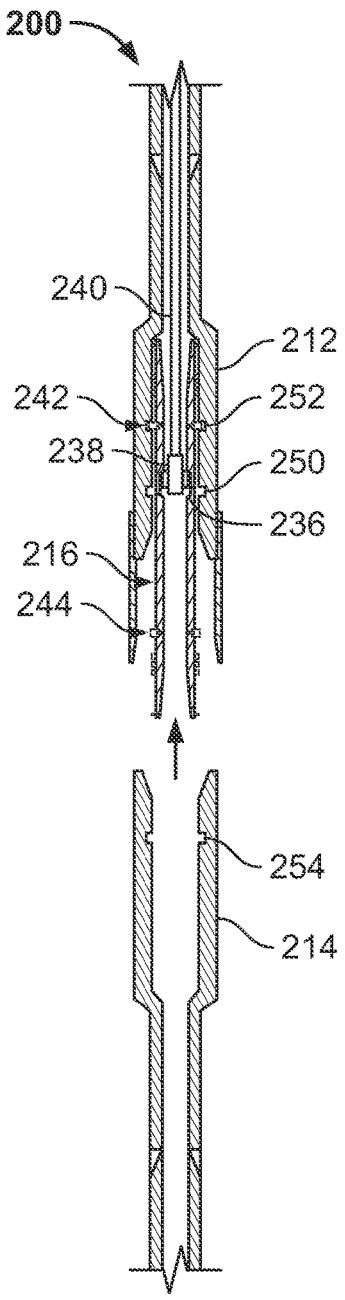
Figure 3C:
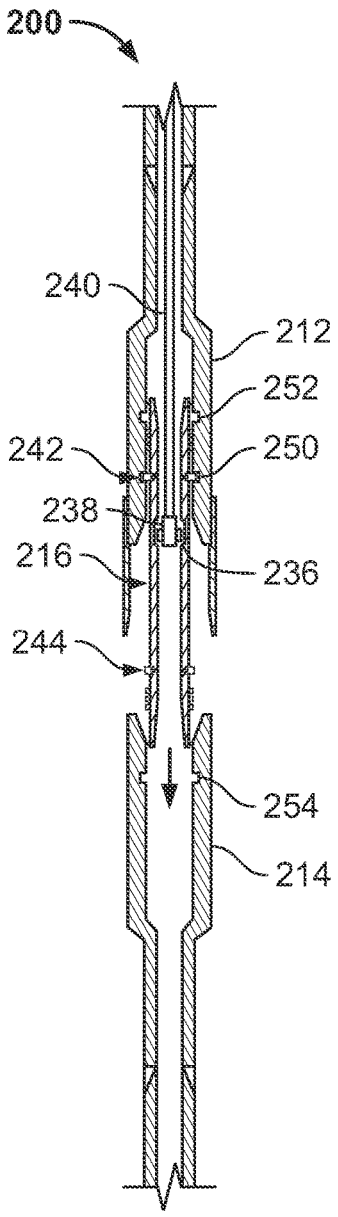
Figure 3D:
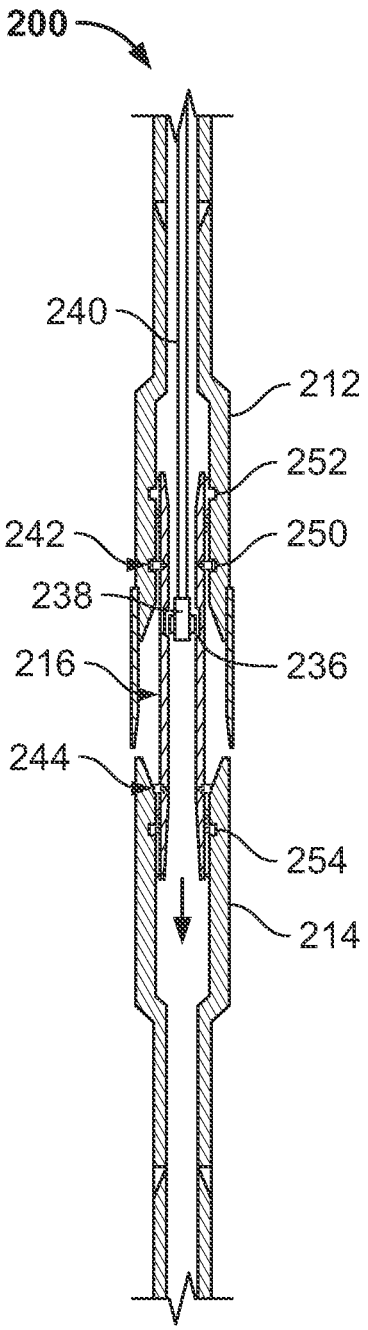
Figure 3E:
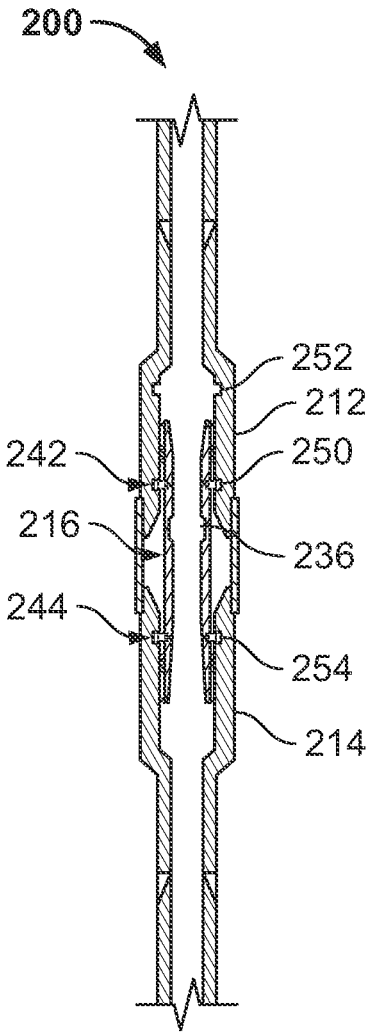

In operation of the example downhole tubing disconnect assembly 200, the shifting tool 238 is run into the wellbore 102, within the central bore of the well string along longitudinal axis A-A. The shifting tool 238 engages with the shifting profile 236 of the actuation sleeve 216, and the shifting tool 238 is jarred in an uphole direction. The jarring motion of the shifting tool 238 disengages the first locking mechanism 242 from the first slot 250 and disengages the second locking mechanism 244 from the third slot 254. In some instances, the jarring motion is sufficient enough to overcome the spring forces holding the locking mechanisms in the engaged position. Once the first locking mechanism 242 and second locking mechanism 244 are disengaged, the actuation sleeve 216 slides in the uphole direction, and eventually to the second position where the first locking mechanism 242 engages with the second slot 252. FIGS. 3A-3E are schematic side views of the example downhole tubing disconnect assembly 200 of FIG. 2 showing an example retrieval and replacement sequence of the example disconnect assembly 200. For example, FIG. 3A shows the example disconnect assembly 200 with the actuation sleeve 216 in the first position and the shifting tool 238 being run into the central bore of the disconnect assembly 200. FIG. 3B shows the example disconnect assembly 200 after the shifting tool 238 engages with the shifting profile 236, jars the actuation sleeve 216 into the second position, and lifts the first tubing portion 212 and actuation sleeve 216 in an uphole direction to separate the actuation sleeve 216 from the second tubing portion 214. FIG. 3C shows the example disconnect assembly 200 with a replacement tubing connected to the first tubing portion 212 and actuation sleeve 216 being run downhole, carried on the shifting tool 238. FIG. 3D shows the actuation sleeve 216 of the example disconnect assembly 200 being positioned into engagement with the second tubing portion 214. FIG. 3E shows the example disconnect assembly 200, where the actuation sleeve 216 is engaged with the second tubing portion 214, and the shifting tool 238 has been removed from the central bore. FIGS. 3A-3E show an example retrieval and replacement sequence performed by the example disconnect assembly 200 of FIG. 2. Although the example operation sequence of FIGS. 3A-3E show the same first tubing portion 212 and actuation sleeve 216 being re-introduced into engagement with the second tubing portion 214, a replacement first tubing portion 212', replacement actuation sleeve 216', or both, can be reconnected with the second tubing portion 214.

Figure 4:
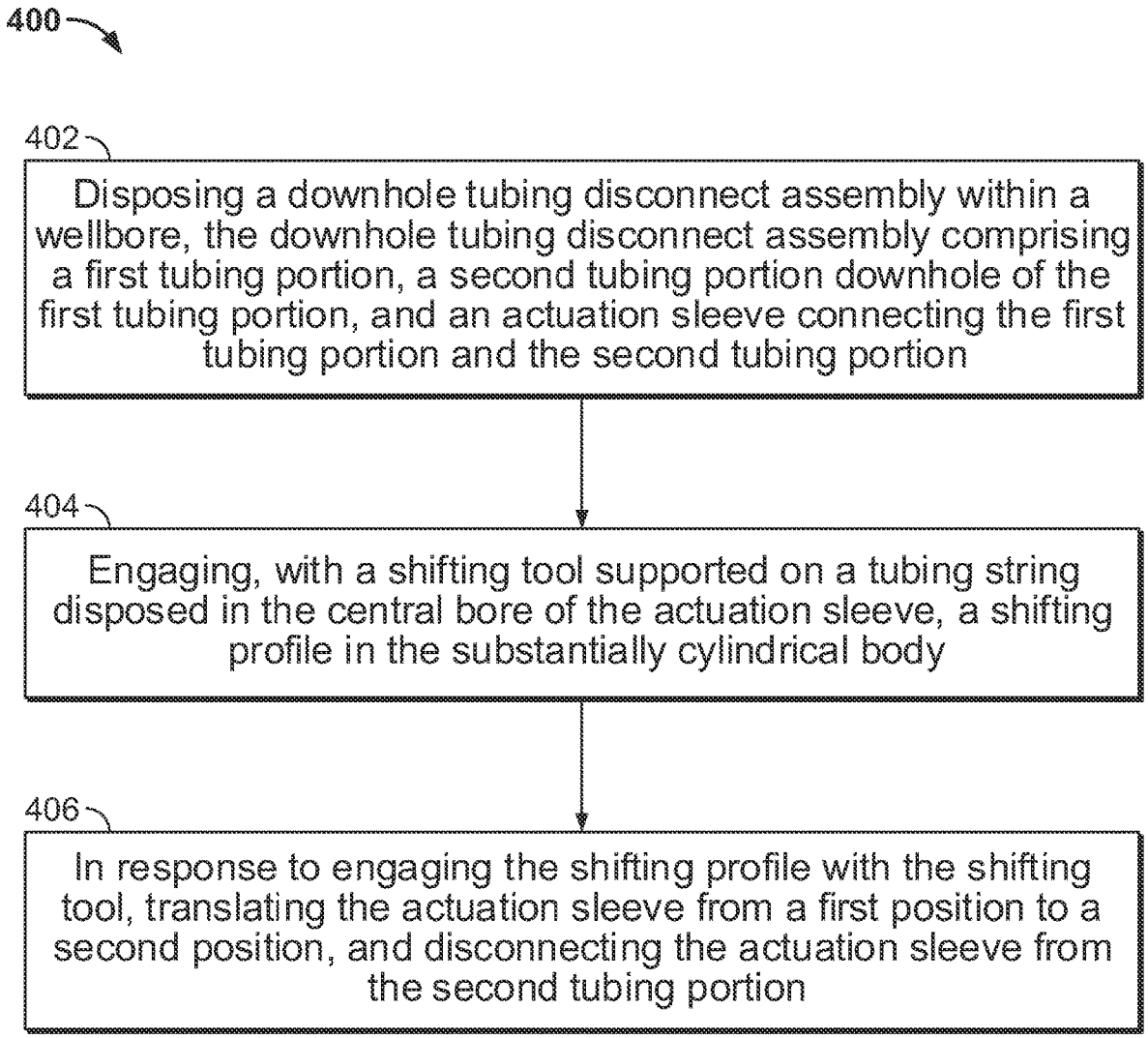
FIG. 4 is a flowchart describing an example method for disconnecting a tubing in a wellbore.

FIG. 4 is a flowchart describing an example method 400 for disconnecting a tubing in a wellbore, for example, performed by the example downhole tubing disconnect assembly 200 of FIG. 2. At 402, a downhole tubing disconnect assembly is disposed within a wellbore. The downhole tubing disconnect assembly includes a first tubing portion, a second tubing portion, and an actuation sleeve connecting the first tubing portion and the second tubing portion. The first tubing portion includes a first inner surface defining a first central bore, and a first outer surface. The second tubing portion, which is positioned downhole of the first tubing portion, includes a second inner surface defining a second central bore in fluid communication with the first central bore, and a second outer surface. The actuation sleeve includes a substantially cylindrical body having a central bore, and the substantially cylindrical body is positioned between the first tubing portion and the second tubing portion. The actuation sleeve connects the first tubing portion and the second tubing portion. At 404, a shifting tool supported on a tubing string disposed in the central bore of the actuation sleeve engages a shifting profile in the substantially cylindrical body of the actuation sleeve. At 406, in response to engaging the shifting profile with the shifting tool, the actuation sleeve translates from a first position to a second position, and the first tubing portion and the actuation sleeve disconnects from the second tubing portion.

In some instances, the shifting tool is positioned within the shifting profile of the substantially cylindrical body, and the shifting tool is jarred, or suddenly pulled, in an uphole direction in order to prompt the translation of the actuation sleeve within the example downhole tubing disconnect assembly. Translating the actuation sleeve from the first position to the second position includes disengaging a first locking mechanism of the actuation sleeve from a first slot of the first tubing portion, subsequently translating the actuation sleeve relative to (for example, along the interior surface of) the first tubing portion, and engaging the first locking mechanism with a second slot of the first tubing portion. Disconnecting the actuation sleeve from the second tubing portion can include disengaging a second locking mechanism of the actuation sleeve from a third slot of the second tubing portion. In some implementations, a perforated shell sub partially or completely surrounds the actuation sleeve, and extends from an outer surface of the first tubing portion to the outer surface of the second tubing portion. The perforated shell sub can include perforations, for example, to equalize pressure between the interior volume of the downhole tubing disconnect assembly and a wellbore annulus surrounding the downhole tubing disconnect assembly. In certain examples, the first tubing portion and the actuation sleeve are removed the wellbore, and a third tubing portion and a second actuation sleeve are run into the wellbore and connect to the second tubing portion.

A number of implementations have been described. Nevertheless, it will be understood that various modifications may be made without departing from the spirit and scope of the disclosure.

What is claimed is:

1. A downhole tubing disconnect assembly, comprising:

a first tubing portion configured to be disposed in a wellbore, the first tubing portion comprising a first inner surface defining a first central bore, and a first outer surface, the first tubing portion comprises a first slot along the first inner surface and a second slot along the first inner surface spaced axially apart from the first slot;

a second tubing portion configured to be disposed in the wellbore downhole of the first tubing portion, the second tubing portion comprising a second inner surface defining a second central bore in fluid communication with the first central bore, and a second outer surface; and an actuation sleeve comprising a substantially cylindrical body positioned between the first tubing portion and the second tubing portion and selectively connecting the first tubing portion and the second tubing portion, the actuation sleeve comprising:

an uphole portion of the cylindrical body configured to selectively engage the first tubing portion, the uphole portion comprising a first locking mechanism configured to position the uphole portion on the first tubing portion, the first locking mechanism configured to engage the first slot in a first position of the actuation sleeve and engage the second slot in a second position of the actuation sleeve, a downhole portion of the cylindrical body configured to selectively engage the second tubing portion, and a shifting profile in the cylindrical body, the shifting profile configured to selectively engage a shifting tool disposed within the wellbore.

2. The downhole tubing disconnect assembly of claim 1, wherein:

the downhole portion of the actuation sleeve comprises a second locking mechanism configured to position the downhole portion on the second tubing portion.

3. The downhole tubing disconnect assembly of claim 1, wherein the first locking mechanism comprises at least one spring-loaded dog configured to reside in the first slot in the first position and reside in the second slot in the second position.

4. The downhole tubing disconnect assembly of claim 1, wherein the second tubing portion comprises a third slot along the second inner surface of the second tubing portion, and the second locking mechanism is configured to engage the third slot in a first position of the actuation sleeve.

5. The downhole tubing disconnect assembly of claim 4, wherein the second locking mechanism comprises at least one spring-loaded dog configured to reside in the third slot in the first position of the actuation sleeve.

6. The downhole tubing disconnect assembly of claim 1, further comprising a perforated shell sub between the first tubing portion and the second tubing portion, wherein the perforated shell sub at least partially surrounds the actuation sleeve and extends from the first outer surface of the first tubing portion to the second outer surface of the second tubing portion.

7. The downhole tubing disconnect assembly of claim 6, wherein the perforated shell sub comprises a plurality of perforations through the perforated shell sub.

8. The downhole tubing disconnect assembly of claim 1, wherein the actuation sleeve comprises a first seal between an outer surface of the uphole portion and the first inner surface of the first tubing portion, and a second seal between an outer surface of the downhole portion and the second inner surface of the second tubing portion.

9. The downhole tubing disconnect assembly of claim 1, wherein the actuation sleeve comprises a full-bore pass-through along an entire longitudinal length of the actuation sleeve.

10. The downhole tubing disconnect assembly of claim 1, wherein the shifting profile in the cylindrical body comprises an indent in an inner surface of the cylindrical body, the indent configured to selectively engage the shifting tool.

11. The downhole tubing disconnect assembly of claim 1, wherein the first tubing portion and the second tubing portion comprises production tubing.

12. A method for disconnecting a tubing in a wellbore, the method comprising:

disposing a downhole tubing disconnect assembly within a wellbore, the downhole tubing disconnect assembly comprising:

a first tubing portion comprising a first inner surface defining a first central bore, and a first outer surface;

a second tubing portion downhole of the first tubing portion and comprising a second inner surface defining a second central bore in fluid communication with the first central bore, and a second outer surface; and an actuation sleeve comprising a substantially cylindrical body having a central bore, the substantially cylindrical body positioned between the first tubing portion and the second tubing portion, the actuation sleeve connecting the first tubing portion and the second tubing portion;

engaging, with a shifting tool supported on a tubing string disposed in the central bore of the actuation sleeve, a shifting profile in the substantially cylindrical body; and in response to engaging the shifting profile with the shifting tool:

translating the actuation sleeve from a first position to a second position, and disconnecting the actuation sleeve from the second tubing portion.

13. The method of claim 12, wherein engaging the shifting profile with the shifting tool comprises:

positioning the shifting tool within the shifting profile of the substantially cylindrical body, and jarring the shifting tool in an uphole direction.

14. The method of claim 12, wherein translating the actuation sleeve from the first position to the second position comprises:

disengaging a first locking mechanism of the actuation sleeve from a first slot of the first tubing portion, translating the actuation sleeve relative to the first tubing portion, and engaging the first locking mechanism with a second slot of the first tubing portion.

15. The method of claim 12, wherein disconnecting the actuation sleeve from the second tubing portion comprises disengaging a second locking mechanism of the actuation sleeve from a third slot of the second tubing portion.

16. The method of claim 12, further comprising at least partially surrounding the actuation sleeve with a perforated shell sub, the perforated shell sub extending from the first outer surface of the first tubing portion and the second outer surface of the second tubing portion.

17. The method of claim 16, wherein:

the perforated shell sub comprises perforations through the perforated shell sub, and surrounding the actuation sleeve with the perforated shell sub comprises equalizing pressure across the perforated shell sub with the perforations.

18. The method of claim 12, further comprising:

removing the first tubing portion and actuation sleeve from the wellbore;

running a third tubing portion and second actuation sleeve into the wellbore; and connecting the third tubing portion and second actuation sleeve to the second tubing portion.

19. A tubing disconnect tool, comprising:

a first tubing portion comprising a first inner surface defining a first central bore;

a second tubing portion separate from the first tubing portion, the second tubing portion comprising a second inner surface defining a second central bore, wherein the first tubing portion and the second tubing portion comprise production tubing; and an actuation sleeve positioned between the first tubing portion and the second tubing portion and selectively connecting the first tubing portion and the second tubing portion, the actuation sleeve comprising a full-bore pass-through fluidly connecting the first central bore and the second central bore, the actuation sleeve comprising:

an uphole portion to selectively engage the first tubing portion, a downhole portion to selectively engage the second tubing portion, and a shifting profile configured to selectively engage a shifting tool.

20. A downhole tubing disconnect assembly, comprising:

a first tubing portion configured to be disposed in a wellbore, the first tubing portion comprising a first inner surface defining a first central bore, and a first outer surface;

a second tubing portion configured to be disposed in the wellbore downhole of the first tubing portion, the second tubing portion comprising a second inner surface defining a second central bore in fluid communication with the first central bore, and a second outer surface; and an actuation sleeve comprising a substantially cylindrical body positioned between the first tubing portion and the second tubing portion and selectively connecting the first tubing portion and the second tubing portion, the actuation sleeve comprising:

an uphole portion of the cylindrical body configured to selectively engage the first tubing portion, a downhole portion of the cylindrical body configured to selectively engage the second tubing portion, and a shifting profile in the cylindrical body, the shifting profile configured to selectively engage a shifting tool disposed within the wellbore; and a perforated shell sub between the first tubing portion and the second tubing portion, wherein the perforated shell sub at least partially surrounds the actuation sleeve and extends from the first outer surface of the first tubing portion to the second outer surface of the second tubing portion.

21. The downhole tubing disconnect assembly of claim 20, wherein the perforated shell sub comprises a plurality of perforations through the perforated shell sub.

* * * * *